US012303000B2

(12) United States Patent
Schaller

(10) Patent No.: US 12,303,000 B2
(45) Date of Patent: May 20, 2025

(54) INSERT FOR A WATCH WRISTLET

(71) Applicant: OMEGA SA, Biel/Bienne (CH)

(72) Inventor: Philippe Schaller, Delémont (CH)

(73) Assignee: OMEGA SA, Biel/Bienne (CH)

( * ) Notice: Subject to any disclaimer, the term of this patent is extended or adjusted under 35 U.S.C. 154(b) by 423 days.

(21) Appl. No.: 17/840,217

(22) Filed: Jun. 14, 2022

(65) Prior Publication Data

US 2023/0140150 A1 May 4, 2023

(30) Foreign Application Priority Data

Nov. 4, 2021 (EP) ..... 21206404

(51) Int. Cl.
*A44C 5/14* (2006.01)

(52) U.S. Cl.
CPC ..... *A44C 5/14* (2013.01)

(58) Field of Classification Search
CPC ..... A44C 5/14; A44C 5/145
See application file for complete search history.

(56) References Cited

U.S. PATENT DOCUMENTS

2005/0217080 A1* 10/2005 Kojoori ..... G04B 37/1486 24/265 WS
2007/0070823 A1* 3/2007 Sima ..... A44C 5/14 368/282
2016/0262504 A1* 9/2016 Schooley ..... G04B 37/1486
2017/0013921 A1* 1/2017 Frei ..... A44C 5/14
2020/0315304 A1* 10/2020 Humbert ..... A44C 5/145

FOREIGN PATENT DOCUMENTS

| | | | | |
|---|---|---|---|---|
| CH | 713724 A2 * | 10/2018 | ..... | A44C 5/00 |
| EP | 3 718 429 A1 | 10/2020 | | |
| FR | 2 634 360 A1 | 1/1990 | | |
| JP | 2020-168218 A | 10/2020 | | |
| WO | 2020/104938 A1 | 5/2020 | | |

OTHER PUBLICATIONS

European Search Report No. 21 20 6404.2 dated Mar. 29, 2022.

* cited by examiner

*Primary Examiner* — Edwin A. Leon
*Assistant Examiner* — Kevin Andrew Johnston
(74) *Attorney, Agent, or Firm* — Sughrue Mion, PLLC

(57) ABSTRACT

An insert for a strand of a watch wristlet to manually lock and unlock the connection between the strand and a strip of a watch case, including a body and a latch, the body having a parallelepiped portion extended by a hook-shaped portion forming a housing for the strip, and the parallelepiped portion configured to be secured to the strand. The latch is hinged to the body to cause it to pivot around a hinge axis and includes a closing wall for closing the housing. The latch has locking means formed by a pin integral with the latch cooperating with a hole in the body and first return means to constrain the pin in the hole in a locking position. The latch has a length less than the length of the cavity so that when the latch is pushed manually in the direction of the hinge axis it releases the pin.

17 Claims, 2 Drawing Sheets

INSERT FOR A WATCH WRISTLET

CROSS REFERENCE RELATED TO APPLICATION

This application claims priority to European Patent Application No. 21206404.2 filed Nov. 4, 2021, the entire contents of which are incorporated herein by reference.

TECHNICAL FIELD OF THE INVENTION

The present invention relates to a device for fastening wristlet strands on a watch case allowing to mount and dismount said wristlet strands on the case without tools.

TECHNOLOGICAL BACKGROUND

The document U.S. Pat. No. 2,850,783 describes a watch wristlet comprising extensible metal strands which are each provided, at one of their ends, with a system comprising a housing extending transversely to the longitudinal direction of the wristlet strand and provided with a transverse opening. The housing is intended to receive a wristlet fastening strip extending between the inner faces of the horns of a watch case. The housing is equipped with a flap that can be moved between a locked position wherein it closes the transverse opening of the housing and thus ensures that the strip is held in the housing and thereby even fastens the wristlet strand to the case and an unlocked position wherein the flap is disengaged from the transverse opening and which allows the wearer of the watch to release the strip from the housing and thus separate the wristlet strand from the case. The flap is locked using tabs bent at 90° which are integral with the shutter and which ensure locking by friction on a rigid edge of the housing. The friction forces involved are relatively low given their small width and the small thickness of the edge against which they bear. Furthermore, after a few locking-unlocking cycles, these tabs are likely to deform plastically and therefore no longer ensure reliable notching or even in the worst case are likely to break and possibly lead to a fall or a loss of the watch. It will also be noted that this system includes three folded sheet metal portions which are quite complex, which makes the system difficult and expensive to produce.

SUMMARY OF THE INVENTION

The main purpose of the present invention is to provide a device for fastening wristlet strands to a watch case allowing to assemble and disassemble said wristlet strands on the case without tools.

The present invention also aims at providing a wristwatch wherein the wristlet strands are provided with a device allowing the manual locking and unlocking of the connection between the strips of the watch case and the wristlet strands of the watch, said system being simple and easy to produce, while guaranteeing secure locking.

Another object of the present invention is to provide an insert that can be integrated into a wristlet strand, said insert allowing the wristlet strand to be assembled and disassembled from a strip of a watch case without tools.

This purpose is achieved by an insert, a wristlet strand and a watch according to the appended claims.

The invention relates to an insert for a strand of a watch wristlet, allowing to manually lock and unlock the connection between the strand and a strip of a watch case, said insert comprises a body made of rigid material and a latch, the body made of rigid material comprising a parallelepiped portion extended by a hook-shaped portion terminating in an edge, said hook-shaped portion forming a housing for the strip, the housing comprising a transverse opening, the parallelepiped portion being configured to be secured to one end of the strand, the latch being housed in a cavity of the body and hinged to the body to cause it to pivot around a hinge axis parallel to the housing, said latch comprising a closing wall capable of closing said housing. According to the invention, the latch comprises locking means formed by a pin integral with the latch cooperating with a hole in the body as well as first return means arranged to constrain the pin in the hole in a locking position, and wherein the latch has a length less than the length of the cavity so that when the latch is pushed manually in the direction of the hinge axis so as to release the pin in an unlocked position wherein the latch is free to pivot around its hinge axis and allows to clear the transverse opening of the housing.

In accordance with other advantageous variants of the invention:

- the insert comprises second return means arranged to hold the latch in the unlocked position;
- the latch comprises a portion with a reduced thickness so as to form a rim, and the cavity comprises two side walls, one of which has a lower height so as to be partially covered by the latch;
- the side wall with a lower height has a slope to limit the angular stroke of the latch relative to the body of the insert;
- the latch has a structured upper surface facilitating the locking and unlocking of the latch by a wearer;
- the rigid material body is a one-piece element;
- the insert is made of metal, of composite material, of ceramic or of plastic material;
- the latch comprises a rear portion pierced with a longitudinal through-hole to receive the axis;
- the latch comprises a housing of circular section, coaxial with the hole, arranged to receive the first return means;
- the housing has a diameter greater than the diameter of the hole;
- the second return means are in the form of a torsion spring;
- the torsion spring is disposed in a machining of the latch around the axis.

The invention also relates to a watch wristlet strand and a watch including a wristlet provided with an insert in accordance with the invention.

Other features and advantages of the present invention will appear in the following description of preferred embodiments, presented by way of non-limiting example with reference to the appended drawings.

BRIEF DESCRIPTION OF THE FIGURES

Other features and advantages of the present invention will appear more clearly upon reading the detailed description of a preferred embodiment which follows, made with reference to the appended drawings given by way of non-limiting examples and wherein.

DETAILED DESCRIPTION OF THE INVENTION

Figure 1A:
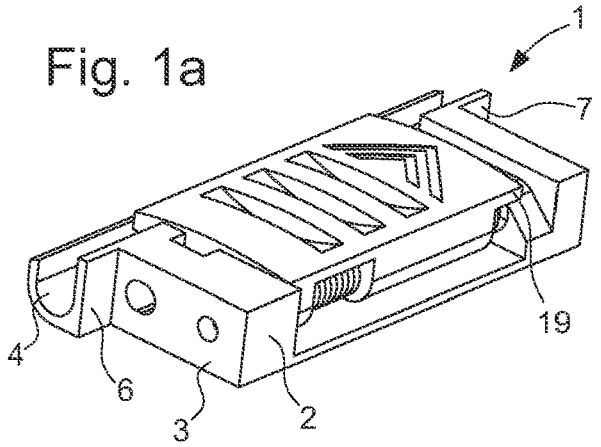
FIGS. 1*a* and 1*b* show an insert in accordance with the invention in its unlocked and locked position.
Figure 1B:
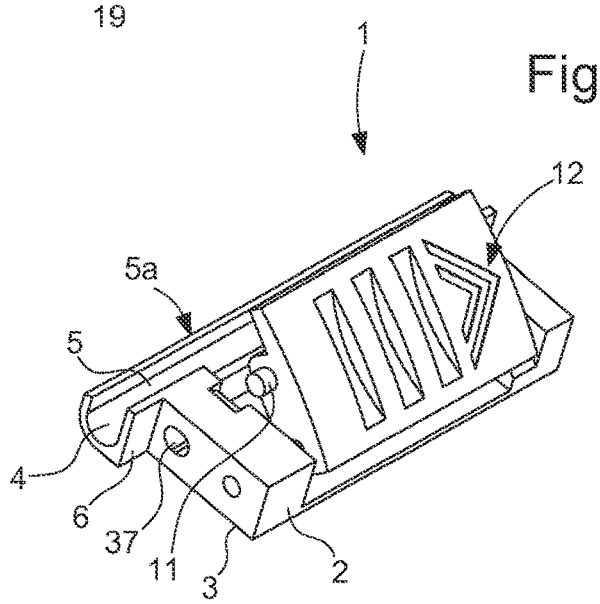

The insert shown in FIGS. 1*a* and 1*b* is formed by a body 2 of rigid material which comprises a parallelepiped portion 3 extended by a hook-shaped end portion 4 which defines a housing 5 intended to receive a strip of a watch case (not shown). The housing 5 extends transversely to the longitudinal direction of the wristlet strand and is provided with a transverse opening 5*a*.

The rigid material body 2 is preferably a uniform part formed from a single material. The body 2 can be made of a metal material or an alloy, a composite material, a ceramic material or else a plastic material.

The parallelepiped portion 3 comprises shoulders 6 which allow to provide good hold or a good grip of the insert 1 to the wristlet strand which is generally over-moulded or glued. For example, the insert can be over-moulded with a synthetic material from which the wristlet strand is formed. Alternatively, the insert can be inserted and glued between two layers of a material from which the strand is formed.

The insert 1 illustrated in FIG. 1 is capable of being inserted into a leather strand 100. The insert can nevertheless easily be adapted to other types and materials (ceramic, rubber, metal, etc.) of strands.

Figure 2:
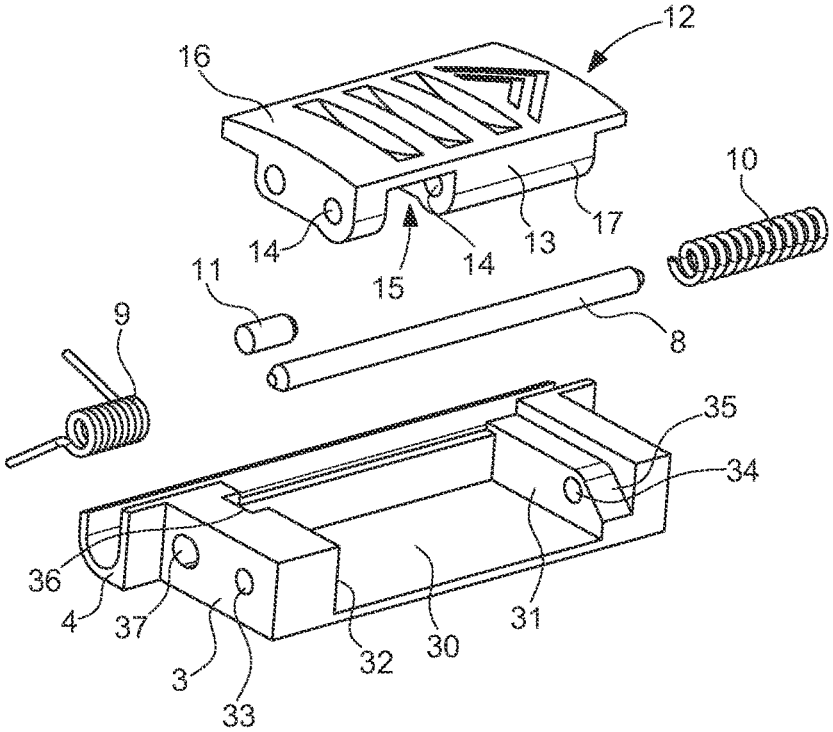
FIG. 2 is an exploded view showing in detail the components of the insert of FIGS. 1*a* and 1*b;*

As illustrated in FIG. 2, it is observed that on the parallelepiped portion 3 of the rigid body 2, a cavity 30 of rectangular shape with two side walls 31, 32 has been machined so as to receive a latch 12. The latch 12 is hinged in rotation around an axis 8 perpendicular to the longitudinal direction of the wristlet, each of the side walls having a hole 33, 34 to receive the axis of rotation. The latch 12 is arranged to rest in the cavity 30 in a position called locking position, and can be moved within this cavity to position it in the open or unlocked position.

The latch 12 is a part made, preferably, of metal, for example steel, aluminium, gold, or other metal material. It is pivotally mounted about an axis 8 parallel to the housing 5 and which is inserted or driven into the holes 33, 34 of the side walls of the cavity 30. The latch 12 has a length slightly less than that of the cavity 30 so as to be able to move it in translation within the cavity 30.

Figure 3A:
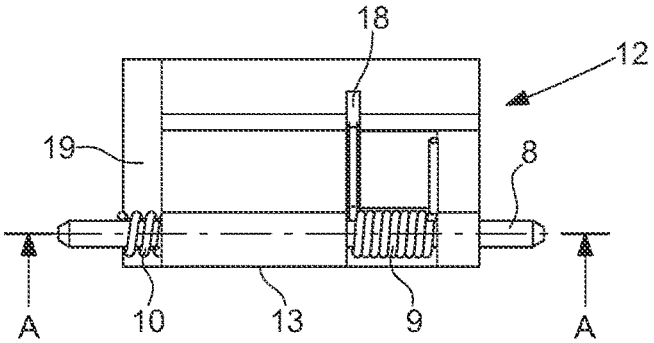
FIG. 3*a* illustrates a bottom view of the latch an insert in accordance with the invention.
Figure 3B:
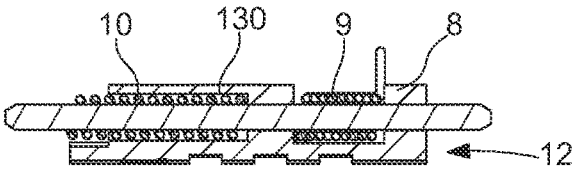
FIG. 3*b* shows a sectional view of the figure along the axis A-A.

The latch 12 comprises a rear portion 13 pierced with a longitudinal hole 14 to receive the axis 8 and whose length is less than the space between the side walls 31, 32. The rear portion 13 of the latch also has a housing 130 for receiving return means such as a compression spring 10 cooperating with one of the side walls 31 of the cavity 30. The housing 130 is coaxial with the longitudinal hole 14 and has a diameter greater than the diameter of the hole 14 so that the spring 10 remains constrained between the wall 31 and the bottom of the housing 130. As illustrated in FIG. 3*b*, the housing 130 extends over half the length of the latch 12. Obviously, the length of this housing 130 may vary depending on the spring used.

The latch 12 further comprises a closing wall 16 having a flat face extending along the longitudinal direction of the housing 5 and resting against the rim 5*a* of the housing, so as to produce a closed housing of section substantially circular when the latch 12 is in the closed position. The latch 12 also comprises locking means and return means arranged to hold the latch in the closed or open position. In the example illustrated, the locking means are formed by a pin 11 integral with the latch 12 and cooperating with an orifice 37 formed in one of the side walls 32 of the space 30. The return means are in the form a torsion spring 9 disposed on the axis 8, the rear portion 13 of the latch 12 having a machining revealing the axis and being arranged to receive the spring 9. As can be seen in FIG. 3*a*, the latch 12 also has a notch 18 provided to receive a leg of the torsion spring 9.

Advantageously, the latch 12 has at the wall opposite the locking means 11, a portion with a reduced thickness so as to form a rim 19 resting on the side wall 31 opposite the side wall 32 cooperating with the locking means 11 and which has for this purpose a lower height so that the rim 19 can rest thereon.

The side wall 31 also has a portion with a slope 35 so that the latch 12 can pivot around its axis 8 without being blocked by the body 2 when it is unlocked. This slope 35 also allows to act as a stop by defining and limiting the angular stroke of the latch 12 relative to the body 2 of the insert 1.

The side wall 32 in turn has a cutout 36 with a slope to guide the locking means 11 to the hole 37 when the latch moves from the unlocked position to the locked position. Thus, when the wearer presses the latch 12 towards the bottom of the cavity 30, the pin 11 contacts the slope and causes a translation of the latch 12 in the direction of the axis 8 and implicitly a compression of the spring 8 until the pin 11 is inserted into the hole 37. Once the pin 11 is housed in the hole 37, the latch returns to its rest position in the cavity 30 under the action of the spring 8.

The latch 12 also acts as a handling element and has on its upper face, that is to say the face visible to the wearer when the latch is in the closed position, shallow machining or textures in negative or positive relief to facilitate the handling of the latch 12.

In the closed or locked position (FIG. 1*b*), the pin 11 integral with the latch 12 is inserted into the hole 37 so as to hold the latch in place in the cavity 30, the torsion spring 9 being forced between the bottom of the cavity and the latch. The pin 11 is held in the inserted position thanks to the spring 10 which tends to push the latch 12 towards the side wall 32.

To switch the latch 12 to its open or unlocked position (FIG. 1*a*), the wearer exerts pressure on the latch 12 and causes it to translate, in a direction perpendicular to the direction of the length of the wristlet strand, until the latter abuts against the side wall 31 of the cavity 30. This translation has the effect of releasing the pin 11 from the hole 37, and therefore of allowing the torsion spring 9 to pivot the latch 12 towards its unlocked or open position, thus freeing the passage 5 to assemble or disassemble the wristlet strand.

Figure 4:
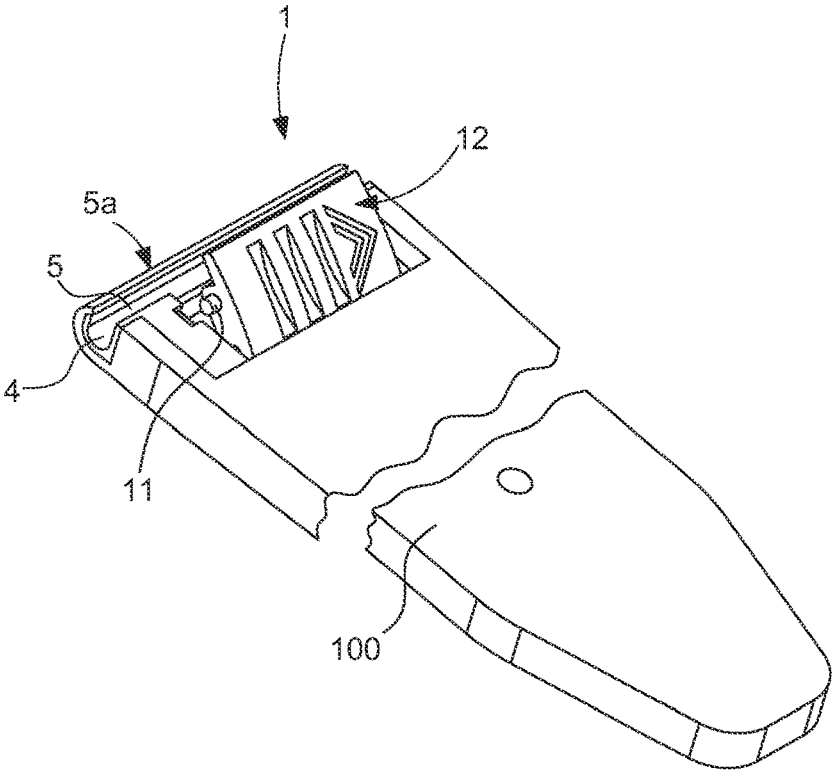
FIG. 4 illustrates an insert in accordance with the invention fitted on a wristlet strand.

To open the tab, the user will push the tab 16 backwards until the edge 17 is disengaged from the notch 22, and then switch the latch 12 towards its open position. As shown in section in FIGS. 4*a*-4*c*, the part of the edge 17 of the hook-shaped portion 4 which fits into the notch 22 is preferably pointed, having in this way a shape which corresponds to the internal shape of the notch 22. Other shapes of notches and corresponding edges can nevertheless be considered.

The invention claimed is:

1. An insert (1) for a strand (10) of a watch wristlet, allowing to manually lock and unlock a connection of the strand (10), said insert (1) comprises a body made of rigid material (2) and a latch (12), the body made of rigid material (2) comprising a parallelepiped portion (3) extended by a hook-shaped portion (4) terminating in an edge (5*a*), said hook-shaped portion (4) forming a housing (5), the housing comprising a transverse opening, the parallelepiped portion (3) being configured to be secured to one end of the strand (10), the latch being housed in a cavity (30) of the body and hinged to the body (2) to cause it to pivot around a hinge axis (8) parallel to the housing (5), said latch (12) comprising a closing wall (16) capable of closing said housing (5), characterised in that the latch (12) comprises locking means formed by a pin (11), the pin (11) is integral with the latch (12) and cooperating with both a hole (37) of the body (2) and first return means (10) arranged to constrain the pin (11) in the hole (37) in a locking position, and wherein the latch (12) has a length less than the length of the cavity (30) configured to, when the latch (12) is pushed manually in the direction of the hinge axis (8), release the pin (11) and place the latch (12) in an unlocked position wherein the latch (12) along with the pin (11) are both free to pivot around the hinge axis of the latch (12) and allows opening and closing of the transverse opening of the housing.

2. The insert (1) according to claim 1, characterised in that it comprises second return means (9) arranged to hold the latch in the unlocked position.

3. The insert (1) according to claim 1, characterised in that the latch (12) comprises a portion with a reduced thickness so as to form a rim (19), and the cavity (30) comprises two side walls (31, 32) one of which has a lower height so as to be partially covered by the latch (12).

4. The insert (1) according to claim 3, characterised in that the side wall (31) with a lower height has a slope (35) to limit the angular stroke of the latch (12) relative to the body (2) of the insert (1).

5. The insert (1) according to claim 1, characterised in that the latch (12) has a structured upper surface (23) facilitating the locking and unlocking of the latch (12) by a wearer.

6. The insert (1) according to claim 1, characterised in that the rigid material body (2) is a one-piece element.

7. The insert (1) according to claim 1, characterised in that the insert is made of metal, of composite material, of ceramic or of plastic material.

8. The insert (1) according to claim 1, characterised in that the latch (12) comprises a rear portion (13) pierced with a longitudinal through-hole (14) to receive the axis (8).

9. The insert (1) according to claim 8, characterised in that the latch (12) comprises a housing (130) of circular section, coaxial with the hole (14), arranged to receive the first return means (10).

10. The insert (1) according to claim 9, characterised in that the housing (130) has a diameter greater than the diameter of the hole (14).

11. The insert (1) according to claim 2, characterised in that the second return means (9) are in the form of a torsion spring.

12. The insert (1) according to claim 11, characterised in that the torsion spring is disposed in a machining (15) of the latch (12) around the axis (8).

13. A strand (10) of a watch wristlet comprising at one end an insert (1) according to claim 1.

14. A watch provided with two strands (10) and two inserts (1) according to claim 1.

15. The insert (1) according to claim 1, wherein the latch (12) being free to pivot around the hinge axis comprises the insert (1) being configured to:

in a closed state of the transverse opening, the latch (12) and pin (11) being pivoted around the hinge axis along a first direction and into the closed state in which both the pin (11) is pivoted around the hinge axis and locked into a cutout (36) of the parallelepiped portion (3) and also part of the transverse opening is covered by part of the latch (12), and wherein the latch (12) pivoting around the hinge axis comprises in a closed state of the transverse opening, and in an open state of the transverse opening, the latch (12) and pin (11) being pivoted around the hinge axis along a second direction, opposite to the first direction, and into the open state in which both the pin (11) is pivoted around the hinge axis and out of the cutout (36) of the parallelepiped portion (3) and also the part of the transverse opening being uncovered by the part of the latch (12).

16. An insert (1) for a strand (10) of a watch wristlet, allowing to manually lock and unlock a connection of the strand (10), said insert (1) comprises a body made of rigid material (2) and a latch (12), the body made of rigid material (2) comprising a parallelepiped portion (3) extended by a hook-shaped portion (4) terminating in an edge (5*a*), said hook-shaped portion (4) forming a housing (5), the housing comprising a transverse opening, the parallelepiped portion (3) being configured to be secured to one end of the strand (10), the latch being housed in a cavity (30) of the body and hinged to the body (2) to cause it to pivot around a hinge axis (8) parallel to the housing (5), said latch (12) comprising a closing wall (16) capable of closing said housing (5), characterised in that the latch (12) comprises locking means formed by a pin (11), the pin (11) is integral with the latch (12) and cooperating with both a hole (37) of the body (2) and first return means (10) arranged to constrain the pin (11) in the hole (37) in a locking position, and wherein the latch (12) has a length less than the length of the cavity (30) configured to, when the latch (12) is pushed manually in the direction of the hinge axis (8), release the pin (11) and place the latch (12) in an unlocked position wherein the latch (12) is free to pivot around its hinge axis and allows to clear the transverse opening of the housing, and wherein the insert (1) is further characterized in that at least one of:

the insert (1) further comprises second return means (9) arranged to hold the latch in the unlocked position, and the latch (12) further comprises a portion with a reduced thickness so as to form a rim (19), and the cavity (30) comprises two side walls (31, 32) one of which has a lower height so as to be partially covered by the latch (12).

17. An insert (1) for a strand (10) of a watch wristlet, allowing to manually lock and unlock a connection of the strand (10), said insert (1) comprises a body made of rigid material (2) and a latch (12), the body made of rigid material (2) comprising a parallelepiped portion (3) extended by a hook-shaped portion (4) terminating in an edge (5*a*), said hook-shaped portion (4) forming a housing (5), the housing comprising a transverse opening, the parallelepiped portion (3) being configured to be secured to one end of the strand (10), the latch being housed in a cavity (30) of the body and hinged to the body (2) to cause it to pivot around a hinge axis (8) parallel to the housing (5), said latch (12) comprising a closing wall (16) capable of closing said housing (5), characterised in that the latch (12) comprises locking means formed by a pin (11), the pin (11) is integral with the latch (12) and cooperating with both a hole (37) of the body (2) and first return means (10) arranged to constrain the pin (11) in the hole (37) in a locking position, and wherein the latch (12) has a length less than the length of the cavity (30) configured to, when the latch (12) is pushed manually in the direction of the hinge axis (8), release the pin (11) and place the latch (12) in an unlocked position wherein the latch (12) is free to pivot around its hinge axis and allows to clear the transverse opening of the housing, and wherein the insert (1) is further characterized in that the latch (12) comprises a rear portion (13), pierced with a longitudinal through-hole (14) to receive the axis (8), and a housing (130) of circular section, coaxial with the hole (14), arranged to receive the first return means (10).

* * * * *